US007281570B2

(12) United States Patent
Koch et al.

(10) Patent No.: US 7,281,570 B2
(45) Date of Patent: Oct. 16, 2007

(54) METHOD FOR THE PRODUCTION OF A CORE SAND AND/OR MOLDING SAND FOR CASTING PURPOSES

(75) Inventors: Karl Koch, Borken (DE); Cornelis Grefhorst, Winterswijk (NL)

(73) Assignee: S & B Industrial Minerals GmbH, Marl (DE)

( * ) Notice: Subject to any disclaimer, the term of this patent is extended or adjusted under 35 U.S.C. 154(b) by 0 days.

(21) Appl. No.: 10/560,350

(22) PCT Filed: Jun. 11, 2004

(86) PCT No.: PCT/EP2004/006306

§ 371 (c)(1),
(2), (4) Date: Jan. 18, 2006

(87) PCT Pub. No.: WO2004/110670

PCT Pub. Date: Dec. 23, 2004

(65) Prior Publication Data

US 2006/0151145 A1 Jul. 13, 2006

(30) Foreign Application Priority Data

Jun. 12, 2003 (DE) ..... 103 26 967

(51) Int. Cl.
*B22C 1/02* (2006.01)
*B22C 1/04* (2006.01)

(52) U.S. Cl. ..... 164/529; 164/520

(58) Field of Classification Search ..... 164/520, 164/529

See application file for complete search history.

(56) References Cited

U.S. PATENT DOCUMENTS 2,828,214 A * 3/1958 Myers et al. ..... 106/38.51
6,598,654 B2 * 7/2003 Prat Urreiztieta ..... 164/16

FOREIGN PATENT DOCUMENTS

| | | |
|---|---|---|
| DE | 30 17 119 | 11/1981 |
| DE | 196 09 539 | 9/1997 |
| EP | 0 032 881 | 7/1981 |
| EP | 0 891 954 | 1/1999 |
| GB | 1 444 280 | 7/1976 |

* cited by examiner

*Primary Examiner*—Kevin P. Kerns
(74) *Attorney, Agent, or Firm*—Collard & Roe, P.C.

(57) ABSTRACT

A method for producing a core sand and/or molding sand for casting purposes mixes a basic granular mineral molding material such as silica sand with an additive based on an organic or inorganic component, a binding agent being optionally added. The additive is coarsely ground prior to the mixing process, more than 50 percent by weight of the grains having a minimum size of approximately 0.05 mm.

11 Claims, 2 Drawing Sheets

METHOD FOR THE PRODUCTION OF A CORE SAND AND/OR MOLDING SAND FOR CASTING PURPOSES

CROSS REFERENCE TO RELATED APPLICATIONS

Applicants claim priority under 35 U.S.C. §119 of German Application No. 103 26 967.3 filed Jun. 12, 2003. Applicants also claim priority under 35 U.S.C. §365 of PCT No. PCT/EP2004/006306 filed Jun. 11, 2004. The international application under PCT article 21(2) was not published in English.

BACKGROUND OF THE INVENTION

1. Field of the Invention

The present invention relates to a method for the production of a core sand and/or molding sand for casting purposes, according to which a basic granular mineral molding material, such as quartz sand, for example, is mixed with an additive based on an organic and inorganic component, if applicable with the addition of a binder, and according to which the mixture essentially has additive grains and basic molding substance grains and/or aggregate grains of the additive and the basic molding material.

The core sand for casting purposes serves, as usual, to define cores in cast pieces. In contrast, molding sand is generally understood to mean a sand that determines the external shape of the cast piece in question. Core sand and molding sand are included in the general category of casting sand. The basic granular mineral molding material is understood to be a mineral basic material in granular form, for representing the desired casting mold. This basic material is generally present in the mixture with the additive and, if applicable, with the binder, in a proportion of 80 to 90 wt.-%, preferably more than 90 wt.-%, and very particularly preferably more than 95 wt.-%. In this connection, the weight data relate to the finished mixture, in each instance. In this connection, the related basic material grains possess an average grain size up to 0.5 mm, mainly in the range between 0.10 mm to 0.30 mm.

2. The Prior Art

A method of the type described initially is disclosed within the scope of DE 196 09 539 A1. This is a composition containing casting sand and an additive, whereby the additive comprises kryolith. Kryolith is known to belong to the mineral class of the halogenides, which characterize the compounds of metals with fluorine, chlorine, bromine, and iodine. Kryolith is used in aluminum metallurgy to a great extent. In addition, a mixture of zeolite (in other words an inorganic component) with at least one component from minerals, wood meals, organic fiber material, hydrocarbons, carbon, etc. (in other words an organic component) are used.

The known method, just like the comparable approaches corresponding to EP 0 891 954 A1, attempts to avoid casting defects, particularly so-called sand expansion defects. These are attributable to expansion of mold substances, i.e. of the mold parts, during casting and solidification within the casting mold, and are known as defect phenomena of cast pieces.

Thus, the metallic material that flows into the casting mold produced from the casting sand, i.e. the core sand and/or molding sand, causes thermally related expansion of the mold piece in question (of the molded casting sand), because of its heat effect due to radiation as well as heat conduction. As a result, there are temperature differences in individual mold part zones, which result in significant differences in tension. If the mechanical/thermal stresses that accompany the tension differences exceed the deformability and the tensile strength of the mold part in the stress cross-section, and if the cast material is sufficiently capable of flow, defect phenomena occur due to liquid material that penetrates into cracks. To put it differently, the actual casting process might result in fine cracks in the molding material, i.e. in the casting sand or casting mold sand, into which the liquid metal can penetrate. The metal therefore leaves its predetermined shape, whereby these defect phenomena are referred to as expansion defects, furrows, leaf ribs, etc.

In this connection, leaf ribs tend to form particularly when using chemically solidified mold substances on the inner contours (cores of the cast parts). Such leaf ribs are consequently difficult to access and require time-consuming and cost-intensive re-finishing by means of polishing the cast part that has been produced. In some cases, the leaf ribs actually cannot be removed at all.

For this reason, in the past, the cores in question have been equipped with a refractory coating, by means of the process of so-called core dressing, by spraying, dipping them, etc. In this way, penetration of the liquid metal into the fine cracks described is supposed to be prevented or at least reduced. However, core dressing is connected with significant effort and expense.

In the state of the art, these defect phenomena, i.e. the leaf rib formation in cast parts, is counteracted in that wood meal, starch, various iron oxides, etc., are added into the quartz sand, i.e. the basic granular molding material. These organic and inorganic additives are able to reduce leaf rib formation, but this is achieved at the cost of a relatively rough casting surface. Here, the invention wants to provide an overall remedy.

SUMMARY OF THE INVENTION

The invention is based on the technical problem of further developing a method of the type stated, for the production of molding sand for casting purposes, in such a manner that not only are defects in cast pieces reduced or entirely eliminated, but also, the cast piece that is produced has a perfect surface.

In order to solve this technical problem, a method of the type stated is characterized, according to the invention, in that the additive (the additive grains) added to the basic granular mineral molding material, on the basis of the organic or inorganic component, is coarsely ground or pelletized with the basic mineral molding material before the mixing process, whereby more than 50 wt.-% of the grains in question have a grain size of at least approximately 0.05 mm.

Alternatively or in addition, however, the aggregate grains can also be appropriately ground or pelletized. In other words, what is important is that the additive grains and/or the aggregate grains are present as ground grains or corresponding pellets having the grain size indicated, in each instance. In this connection, the pellets can be produced by means of the pelletization of powders. This then holds true both for the additive grains and the aggregate grains.

In every case, the finished mixture is consequently composed of the basic material, at the values already indicated in the introduction (80-90 wt.-%, preferably more than 90 wt.-%, and particularly preferably more than 95 wt.-%) and the remainder being additive, plus binder(s), if applicable. In this connection, the basic molding material grains have the average grain size indicated, less than 0.50 mm, generally in the range from 0.10 mm to 0.30 mm. The additive grains, in other words the grains of the additive, are now added to this basic molding material; of these, more than 50 wt.-% (with reference to the additive) have a grain size of at least approximately 0.05 mm.

If aggregate grains or an aggregate are/is used alternatively or in addition, in other words basic molding material grains having a sheath of the additive, these are also present in the indicated grain size spectrum of more than 50 wt.-% with a grain size of at least approximately 0.05 mm. In this case, as well, the weight proportion of the basic molding material (with reference to the finished mixture) is at the values indicated (more than 80 wt.-%). The value for the additive is comparable (less than 20 wt.-%).

Preferably, even more than 80 wt.-%, particularly more than 90 wt.-% of the additive grains and/or aggregate grains have a grain size of at least approximately 0.05 mm. A grain size distribution according to which more than 80 wt.-%, particularly more than 90 wt.-% of the additive grains and/or the aggregate grains have a grain size of approximately 0.09 mm, in most cases actually more than 0.10 mm, has particularly proven itself.

The grain size distribution values mentioned above are usually determined by means of known sifting processes, in that the starting material to be sifted is generally treated using one or more mechanical sifting processes, with regard to the required grain size. If the predetermined grain size has not yet been reached within the course of the prior grinding process described, fractions of the grains that have been appropriately moved out of the circulation system are passed in a circulation system until the indicated grain size distribution has been achieved. In this connection, usual mills such as bowl mill crushers, ball mills, or also chaser mills, if necessary, can be used for the grinding process. An ultra-rotor mill is also possible.

The additive grains and/or aggregate grains are separated into the proportion having the desired grain size and the material that is still too course and must be re-circulated, by means of separation (using mechanical screens or by means of air separation), in the mill in question or directly after it. The overly coarse material is therefore in a circulation system having an undefined length. One would proceed in similar manner if the additive grains and/or the aggregate grains have reached their coarseness by means of the pelletization of powders. In this case, as well, the desired grain size is made available by means of the separation described—if necessary in combination with a grinding process. This means that the processes of grinding as well as pelletizing the additive grains and/or the aggregate grains can be used both as alternatives and in combination, according to the invention.

Because of the coarse-grain configuration of the additive, which is added to the basic molding material and composed of different materials, namely an organic and an inorganic component, particular advantages are obtained. The same holds true if one works with the aggregate grains that have been produced by means of impregnation of basic material grains with the additive. This is because the expansion pressure that proceeds from the molding part during the casting process can be buffered over a wide temperature range.

Thus, in the low temperature range starting from approximately 250° C. to 800° C., softening and evaporation of the organic materials, i.e. of the organic component of the additive, which generally contains more than 50 wt.-% carbon, mainly takes place, so that the property described above can be explained. In this way, the organic component takes the expansion of the molding part into consideration. At higher temperatures above 500° C. and more, the inorganic component on a regular mineral basis increasingly softens, or can also react with the molding material. All of this leads to the result that possible pressure stresses due to expansion of the molding material, i.e. the basic molding material, particularly in the region of the core, are eliminated.

It has been shown that the additive or aggregate must be present, overall, in a coarse grain in the grain distribution described, so that the specific surface is reduced in comparison with a fine grain distribution (having grains smaller than 0.05 mm). This reduction in the specific surface of the additive or aggregate has the result that the binder consumption, i.e. the consumption of binder during the production of the casting cores and molds, respectively, is less than if a fine-grain additive is used, specifically with comparable strength values of the mold part.

Because the addition of binder is reduced while maintaining the same strength, problems that can result from evaporation of the binder and its partial combustion, during the subsequent casting process, are, of course, also reduced. Furthermore, the organic component of the additive ensures, by means of the formation of a reducing gas atmosphere, that the binder decomposition is delayed during this process (the combustion of the binder), and that the expansion of the mold part assumes increased values only at higher temperatures. In fact, the carbon of the organic component that is released ensures the reducing gas atmosphere described, which delays the binder decomposition by means of its oxygen consumption. Consequently, the binder ensures that the mold part retains its shape over a large temperature range, and that expansion of the mold part assumes increased values only at the higher temperatures mentioned.

This is particularly true for the case if the organic component of the additive preferably has maximally approximately 60 wt.-%, preferably maximally 50 wt.-%, of ingredients that are volatile at temperatures of approximately 250° C. to 500° C., particularly approximately 400° C. to 500° C., preferably up to approximately 500° C. By means of this dimensioning rule, it is ensured that the organic component develops relatively little gas during heating of the mold part in question, in other words during the casting process. The likelihood of the occurrence of defects is thereby significantly reduced. This means that as soon as the casting mold, i.e. the core sand and/or molding sand according to the invention has reached the temperature indicated (approximately 250° C. to 800° C., particularly approximately 400° C. to 500° C., preferably approximately 500° C.), the ingredients indicated (maximally approximately 60 wt.-%, preferably approximately 50 wt.-%) of the (organic) component of the additive have evaporated, and have consequently entered into the gas phase. The rest of the (organic) component, in contrast, is present unchanged, in solid or at most slightly plastic form.

It is known that the solubility and volatility of organic compounds in general, consequently of the organic component of the additive, is determined by the molecule size and intermolecular interactions in each instance. Small molecules tend to volatilize more than large ones, and also then those molecules that have a lesser bonding energy than others. Accordingly, the weight proportion of volatile ingredients stated above, of maximally approximately 60 wt.-% and preferably maximally approximately 50 wt.-% of the organic component of the additive, taking into consideration heating in the range of approximately 250° C. to 800° C., particularly in the range of approximately 400° C. to 500° C., preferably up to approximately 500° C., can easily be adjusted.

This means that as soon as the organic component of the additive has reached the indicated temperature range up to approximately 800° C., the indicated weight proportion has volatilized to a maximal extent.

Measures according to the invention, according to which the oxygen content of the (organic) component is less than 30 wt.-%, particularly less than 20 wt.-% (with reference to the (organic) component), aim in the same direction. This aspect also makes a major contribution to delaying the binder decomposition. This is because the volatilization and partial shrinkage of the binder during the casting process has the result that the core, in particular, shrinks and afterwards expands. This shrinkage process and the accompanying binder decomposition are delayed if little oxygen, which promotes the combustion process, escapes from the (organic) component.

For the remainder, limiting the oxygen content of the preferably organic component of the additive ensures that the reducing gas atmosphere of the organic component of the additive that forms during the casting process is actually able to slow down the binder decomposition and is not bound by the oxygen that is released.

It has proven itself if the organic component is up to 90 wt.-%, and the inorganic component is up to 80 wt.-% of the additive, whereby of course the sum of organic and inorganic component is 100 wt.-%. In combination with the fact that the organic component contains 50 to 98 wt.-% carbon, i.e. coal or hydrocarbons, there is another advantage. This lies in the fact that during the casting process and the accompanying volatilization process of the organic component, the carbon is present in the gas phase because of the high carbon content, i.e. is introduced into the gas phase that is formed by the volatilizing organic component. The organic component partially swells up, becomes plastic, and gives its volatile components off towards the outside, so that carbon particles are thereby released and can form glance coal from the gas phase. In this connection, the glance coal is able to ensure that the parting layer is perfectly maintained between mold part and metal casting. In this way, the casting surface can be improved, so that in general, it is possible to do without the core dressing described initially.

Usually, the organic substances used are coal, hydrocarbon resins, bitumen, organic fiber materials, possibly oils, natural resins, etc. As inorganic components, the invention recommends the use of perlites, spodumenes, chromite sands, glass, foam glass, colemanite, mica, iron oxide, or light ceramic materials, which can have a surface impregnation, if necessary. In this connection, the water content of the additive is generally less than 10 wt.-%.

Fundamentally, mixing of the basic granular mineral molding material and the additive can take place in dry manner. However, it is also possible that the grains of the basic molding material are sheathed with or by the additive. Just as well, the additive can be glued onto the basic molding material grains together with a binder sheath, i.e. a corresponding binder, or the basic molding material grains can be impregnated, using the binder mentioned, if necessary.

In this case, mixing means that the grain of the basic molding material is disposed in the interior of an additive sheath, in each instance, whereby the aggregate grain formed in such a manner possesses the required grain distribution of more than 50 wt.-% of the grains having a grain size of at least approximately 0.05 mm, in unchanged manner. This means that the mixture described includes aggregate grains of the additive and the basic molding material, as described. Such aggregate grains are generally characterized in that the basic molding material grain, in each instance, is equipped with the sheathing of the additive.

After the metal is cast, the organic component in the additive promotes core decomposition, whereby the core sand with additive residues is added to the remaining molding sand for the external mold. This molding sand mostly contains bentonite. In this case, the additive acts as a glance carbon forming agent. It therefore has a dual function.

First of all, the additive according to the invention ensures that defect phenomena in the core of a cast part are reduced or completely suppressed, whereby this applies, in particular, for leaf ribs. Furthermore, a particularly smooth surface, as compared with the past, is achieved. Furthermore, the carbon component in the additive in question, which is not insignificant and was described above, leads to the result that when the core sand is mixed with the remaining molding sand, the carbon can develop an effect as a glance coal (carbon) forming agent for the entire casting piece, on the core side and on the mold side.

DETAILED DESCRIPTION OF PREFERRED EMBODIMENTS

Figure 1:
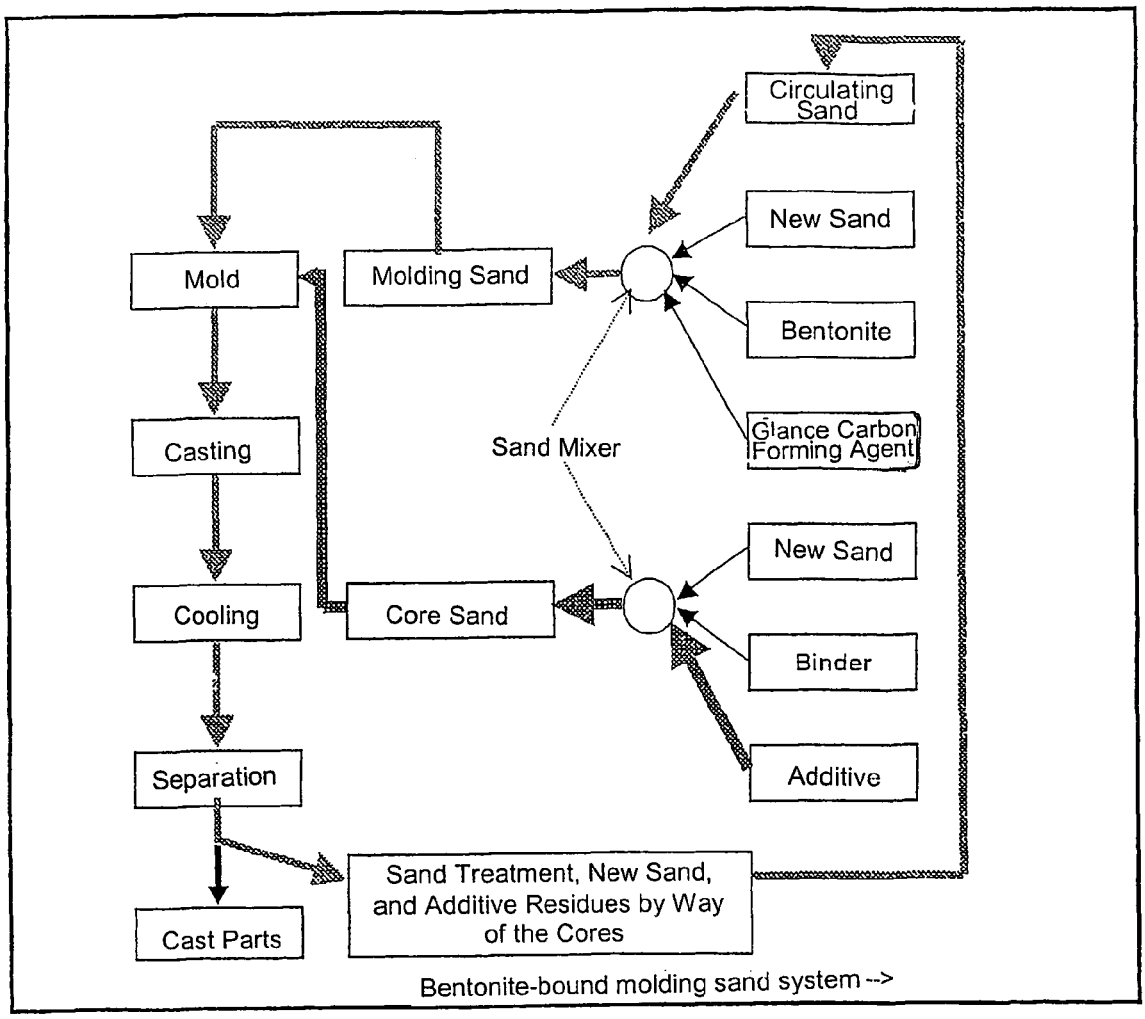
FIG. 1. shows individual method steps in the production of mold sand for casting purposes according to the invention.

FIG. 1 explains the individual method steps in the production of the mold sand for casting purposes according to the invention. In this connection, a differentiation is made, in the example, fundamentally and not necessarily, between a molding sand for the core of a cast piece to be produced (core sand) and for the outer shape (remaining core sand or molding sand). Both different types of molding sand can, however, be produced according to the same sequence schematic.

Within the framework of the exemplary embodiment, the core sand is produced from new sand, i.e. from the basic molding material having an average grain size of 0.10 mm to 0.30 mm, and the binder already described (phenolic resin, for example, particularly PUR, i.e. polyurethane resin), as well as the additive of the organic and inorganic component that has been ground to a coarse grain. In contrast, so-called circulating sand, as well as new sand in combination with bentonite and a glance carbon forming agent, are used as molding sand.

As already described, the additive according to the invention takes on the function of the glance carbon forming agent for the molding sand for producing the external shape, in whole or in part. As a consequence of the coarse structure of the additive according to the invention, the binding capacity of the binder is only minimally influenced during the production of the core sand, specifically taking into consideration a reduced consumption of binder. At the same time, the additive described ensures an improved casting surface, so that the dressing, i.e. core dressing described is not necessary. Finally, the additive has a positive effect on the remaining molding sand during mixing with the molding sand, because it can take over the function of the glance carbon forming agent, in whole or in part.

This means that the core sand is mixed with the molding sand, so that the additive that is present in the core sand also gets into the molding sand in this way. Therefore the addition of glance carbon forming agent to the molding sand can be reduced. The binder also gets into the molding sand by way of the core sand. After sand treatment, the circulating sand obtained in this manner serves as the basic molding material for the mold sand.

Figure 2:
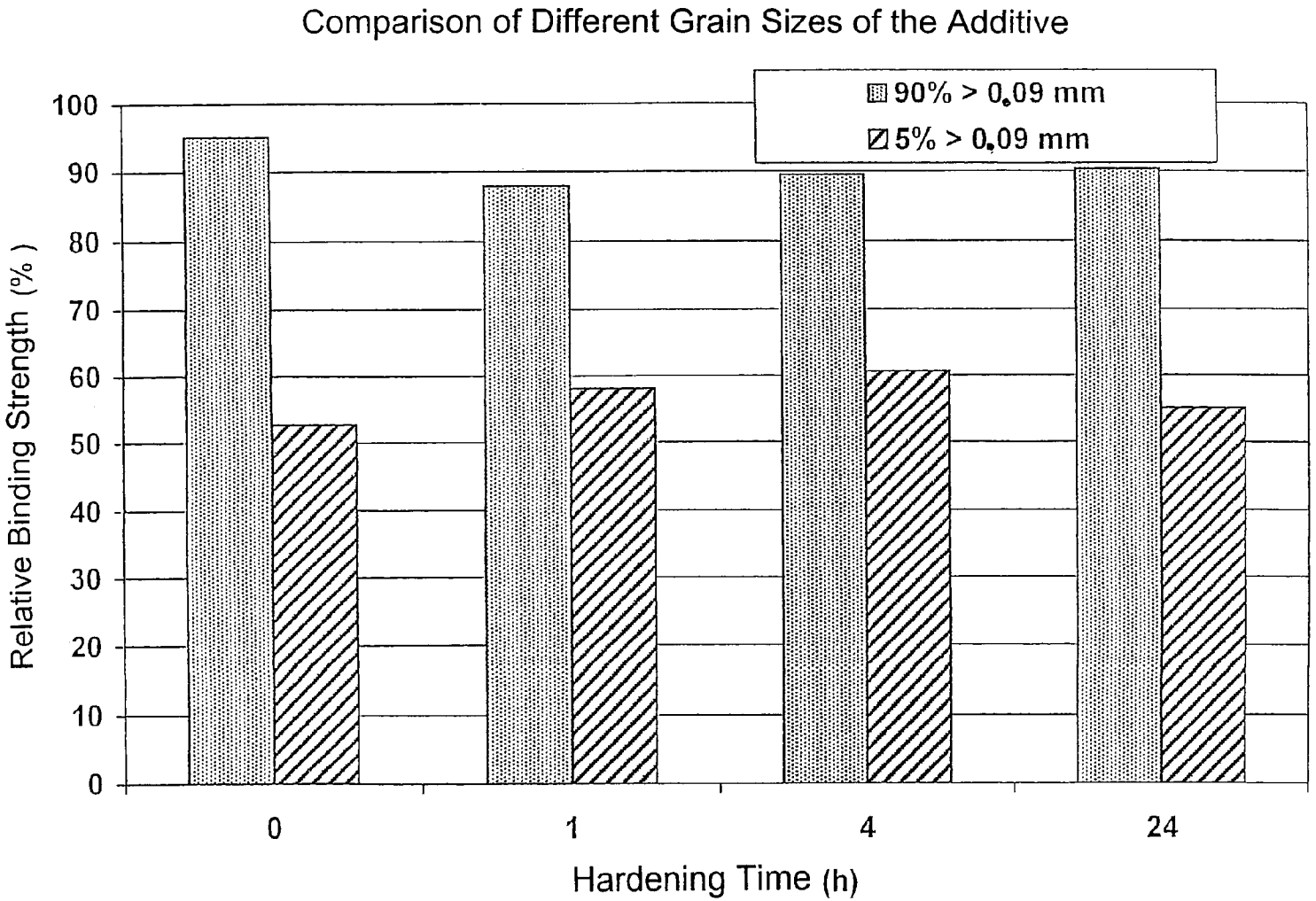
FIG. 2 is a graph comparing different sizes of the additive used in the method according to the invention.

On the basis of FIG. 2, it becomes clear how the grain size of the additive according to the invention affects the strength values obtained for the core sand. In this connection, quartz sand having an average grain size of 0.19 mm to 0.30 mm was used as the basic granular mineral molding material. It turns out that the strength is greatest when more than 90 wt.-% of the grains of the additive have a size of 0.09 mm and more. This holds true over the entire hardening times shown, up to 24 hours. In this connection, the hardening times relate to the cast part produced in the casting mold. In this connection, the relative binding strength of the molding sand and/or core sand according to the invention was determined on the basis of the expansion behavior.

In this connection, the expansion/contraction behavior was determined and assessed using a molding material dilatometer. The greater the relative binding strength, the less the effect of temperature on the expansion/contraction. This means that the corresponding molding sands and/or core sands in which 90 wt.-% of the grains of the additive have a size of 0.09 mm and more are more shape-stable, when viewed over temperature, than comparable materials.

In contrast, a grain size at which only 5 wt.-% of the ground grains of the additive are configured to be larger than 0.09 mm leads to the result that the relative bending resistance is clearly reduced. In the case of the example described, the additive according to the invention was added to the quartz sand at 3 wt.-%. The binder has assumed a proportion of approximately 0.8 wt.-%, with reference to the core sand mixture, i.e. the casting mold sand as a whole.

By means of the limitation, according to the invention, of the volatile ingredients of the organic component of the additive to maximally 60 wt.-%, preferably maximally 50 wt.-%, with reference to the weight of the organic component as a whole, the gas development can be reduced by 60 to 80% as compared with additives used until now, such as wood meal and starch. It is very particularly preferred if the organic component of the additive has maximally approximately 35 wt.-% of volatile ingredients (in the temperature range up to approximately 800° C., in each instance). In this way, the gas amount emitted in the indicated temperature range of 250° C. to 800° C., particularly 400° C. to 500° C., preferably up to approximately 500° C., can be restricted to less than 400 ml/g, whereas wood meal and starch have gas amounts of more than 900 ml/g and, in part, even more than 1000 ml/g at this point.

In addition, the time up to maximal gas development as a result of heating of the molding material is lengthened as compared with the state of the art. Thus, it has turned out that the maximal gas development with the additive according to the invention occurs only after more than 100 sec, preferably actually only after a time of more than 2 minutes. In contrast, the maximal gas development in the state of the art already occurs after approximately 1 minute, or 60 to 70 sec., respectively, in the case of wood meal or starch, respectively.

Because of this fact, the decomposition of the binder during casting is delayed, as a whole, because the organic component contains little oxygen and furthermore, the gas development starts only after a longer time and at a higher temperature of the core sand in comparison with the state of the art. In this way, the total expansion of the core sand and the pressure stress build-up related with it are delayed, so that as a consequence of this, the formation of defect phenomena in the cast piece is reduced.

The following exemplary embodiment relates to the recipe for the production of a core sand according to the invention.

In this connection, quartz sand having the specification H 33, that means having an average grain size of approximately 0.19 to 0.30 mm, is mixed with the following components in a blade mixer. 0.6 wt.-% of a phenolic resin as well as 0.6 wt.-% isocyanate is used as a binder. 3 wt.-% of the additive according to the invention is added to the mixture. The rest (95.8 wt.-%) is made up of the quartz sand.

In this connection, the additive described is composed of 45 wt.-% coal, i.e. carbon having an average grain size of 0.2 mm, and components that are volatile (up to approximately 500° C.) of 30 wt.-% and less. In addition, there are 10 wt.-% of a coal having the same grain size (approximately 0.2 mm), but containing components that are volatile (up to approximately 500° C.) of 15 wt.-% and less. In addition to these 55 wt.-% coal or carbon, in total, there are approximately 30 wt.-% of a mineral component having a grain size of approximately 0.3 mm, which is a lithium mineral, particularly spondumenes.

Furthermore, a binding substance in the form of approximately 3 wt.-% hydrocarbon resin having a grain size of approximately 0.06 mm is taken into consideration. Finally, iron oxide having a grain size of 0.3 mm is added at 2 wt.-%. The finish is 5 wt.-% modified bitumen resin having a grain size of 0.6 mm, as well as 5 wt.-% perlite having a grain size of 0.3 mm.

Consequently, at least 85 wt.-% (45 wt.-%+10 wt.-%+30 wt.-%) have a grain size of 0.2 mm and 0.3 mm, respectively, in other words lie above 0.05 mm. The binder proportion in the additive is approximately 8 wt.-% (5 wt.-% modified bitumen resin plus 3 wt.-% hydrocarbon resin).

The organic component (45 wt.-%+10 wt.-% coal or carbon, as well as 3 wt.-% hydrocarbon resin, 5 wt.-% bitumen resin comes up to 63 wt.-%. The remaining 37 wt.-% form the inorganic component of the additive (30 wt.-% lithium mineral+5 wt.-% perlite, as well as 2 wt.-% iron oxide). The organic component has volatile ingredients of approximately 45 wt.-% (30 wt.-%+15 wt.-%). Finally, it should also be pointed out that the surface of the additive grains and/or the aggregate grains can be sealed off with a coating or by means of impregnation (with a binder).

The invention claimed is:

1. A method for producing a core sand or molding sand for casting purposes comprising the steps of:

(a) providing an additive having an organic component and an inorganic mineral component, the organic component containing over 50 wt.-% carbon and less than 30 wt.-% oxygen, the additive having a water content of less than 10 wt.-% and emitting a gas amount in a temperature range of 250° C. to 800° C. of less than 500 ml/g;

(b) coarsely grinding or pelletizing additive grains of the additive so that more than 50 wt.-% of the additive grains have a grain size of at least approximately 0.05 mm; and (c) subsequently mixing a granular mineral molding material with molding material grains having an average grain size less than 0.50 mm with the additive grains to form a finished mixture comprising over 90 wt.-% of the molding material and a residual amount comprising the additive and if necessary binding agents.

2. The method according to claim 1, wherein the organic component of the additive constitutes up to 90 wt.-%.

3. The method according to claim 2, wherein the oxygen content, of the organic component of the additive is less than 20 wt.-%.

4. The method according to claim 2, wherein the organic component contains up to 50 to 98 wt.-% carbon, with reference to the weight of the component.

5. The method according to claim 2, wherein the organic component is selected from the group consisting of coal, hydrocarbon resins, bitumen, and mixtures thereof.

6. The method according to claim 1, wherein the gas amount emitted by the additive is less than 350 ml/g when heated until a temperature in the range of 250° C. to 800° C. is reached.

7. The method according to claim 1, wherein more than 70 wt.-% of the additive grains possess a grain size of at least approximately 0.05 mm.

8. The method according to claim 7, wherein more than 90 wt.-% of the additive grains possess a grain size of at least approximately 0.09 mm.

9. The method according to claim 1, wherein the inorganic component constitutes up to 80 wt.-% of the additive.

10. A method for producing a core sand or molding sand for casting purposes comprising the steps of:

(a) impregnating and coating granular mineral molding sand grains having an average grain size less than 0.50 mm with an additive having an organic component and an inorganic mineral component, the organic component containing over 50 wt.-% carbon and less than 30 wt.-% oxygen, the additive having a water content of less than 10 wt.-% and emitting a gas amount in a temperature range of 250° C. to 800° C. of less than 500 ml/g, to form aggregate grains of molding material grains impregnated and encased with the additive; and (b) coarsely grinding and pelletizing the aggregate grains to form a finished mixture wherein more than 50 wt.-% of the additive grains have a grain size of at least approximately 0.05 mm, the finished mixture comprising over 90 wt.-% of the molding material and a residual amount comprising the additive and if necessary binding agents.

11. The method according to claim 10, wherein the aggregate grains have a sealed surface.

* * * * *

UNITED STATES PATENT AND TRADEMARK OFFICE

CERTIFICATE OF CORRECTION

PATENT NO. : 7,281,570 B2
APPLICATION NO. : 10/560350
DATED : October 16, 2007
INVENTOR(S) : K. Koch et al.

It is certified that error appears in the above-identified patent and that said Letters Patent is hereby corrected as shown below:

Column 9, line 6, (Line 2 of Claim 3), please delete "," after the word: "content".

Signed and Sealed this

Twenty-fifth Day of December, 2007

JON W. DUDAS
*Director of the United States Patent and Trademark Office*